United States Patent [19]

Bossard

[11] Patent Number: 4,737,169

[45] Date of Patent: Apr. 12, 1988

[54] ELECTROSTATIC FILTER

[76] Inventor: Peter R. Bossard, 33 Oswin Turn., Langhorne, Pa. 19047

[21] Appl. No.: 855,071

[22] Filed: Apr. 22, 1986

[51] Int. Cl.[4] ..... B03C 3/01; B03C 3/45

[52] U.S. Cl. ..... 55/126; 55/132; 55/131; 55/155

[58] Field of Search ..... 55/126, 132, 131, 130, 55/155

[56] References Cited

U.S. PATENT DOCUMENTS

| | | | |
|---|---|---|---|
| 2,571,079 | 10/1951 | Warburton | 55/131 |
| 2,847,082 | 8/1958 | Roos | 55/132 |
| 3,724,174 | 4/1973 | Walkenhorst | 55/131 X |
| 3,930,815 | 1/1976 | Masuda | 55/131 X |
| 4,323,374 | 4/1982 | Shinagawa et al. | 55/132 |

*Primary Examiner*—Kathleen J. Prunner

[57] ABSTRACT

An improved electrostatic filter particularly for use in high performance clean rooms for the semiconductor industry is achieved by forming a layer of wires in a "plane" having corrugations along an axis perpendicular to the axes of the wires. The "plane" is designed to mate with the corrugations of a mechanical filter placed immediately upstream in the air flow path. Alternate wires of the layer are maintained electrically at opposite polarities to strengthen the fields and the corrugations permit closer movement of particles to the wires without unacceptable constriction of the air flow. A multilayered filter produces attractive field configurations, like those achieved by corrugated single plane filters herein, in the absence of a corrugated geometry.

7 Claims, 2 Drawing Sheets

ELECTROSTATIC FILTER

FIELD OF THE INVENTION

This invention relates to electrostatic filters and more particularly to such filters which are operative to trap exceedingly small particles.

BACKGROUND OF THE INVENTION

Electrostatic filters are well known in the art both for home and industrial use. Such filters typically employ wires astride the air path where the wires are maintained at a high potential designed to attract particles in the air. The filters are used along with mechanical filters designed to trap particles of relatively gross size earlier in the air stream. Filter systems of this type are found in many forced air systems for home use and in clean rooms used for example in semiconductor manufacture.

Particularly for use in the semiconductor industry, the demand for systems which remove smaller and smaller particles from the air is acute. This requirement arises from the fact that integrated circuits with smaller and smaller feature size suffer significant damage from air borne contaminants of smaller and smaller size. These contaminants decrease yields of semiconductor devices and thus increase costs. It is well known that the elimination of smaller and smaller air borne particles is a major concern of the semiconductor industry.

The approach to eliminating smaller and smaller particles is to employ better mechanical filters and stronger electric fields. But such means obstruct the air flow and result in an increased kinetic energy for the particles. This, in turn, reduces the effectiveness of the mechanical filter and the fields. One particularly effective mechanical filter, the HEPA filter, has a corrugated cross section exposing a relatively large area of filter material to air borne particles without excessive obstruction of the air path. Such filters are of the type used in car air filters. But even these filters increase the kinetic energy of air borne particles enough such that trapping of particles on the order of microns in diameter is achieved only with very elaborate and costly systems.

BRIEF DESCRIPTION OF THE INVENTION

In accordance with the principles of the present invention, a "plane" of wires is positioned just down stream of a corrugated mechanical filter in the air stream to be filtered. The "plane" of the wires may also be corrugated and mated with the corrugations of the mechanical filter. The wires are electrically insulated and alternate wires of the plane are maintained at relatively high voltages of opposite polarity. The wires are closely spaced, but because of the corrugated configuration and because of the use of opposite polarities on adjacent wires, attractively high fields are achieved with relatively little obstruction of the air path. Also because of the corrugated configuration, those fields are operative in close proximity to the mechanical filter where the fields are most effective. In an alternative embodiment, the equivalent effect of the corrugation is achieved by a filter with alternating sub planes of wires. The desired field configurations are achieved between oppositely-charged wire segments in adjacent planes. It is believed that the use of fields of opposite polarities on adjacent wires, the corrugated configuration of the wire plane (or planes), and the placement of the wires in close proximity to the mechanical filter are departures from prior art thinking.

DETAILED DESCRIPTION

Figure 1:
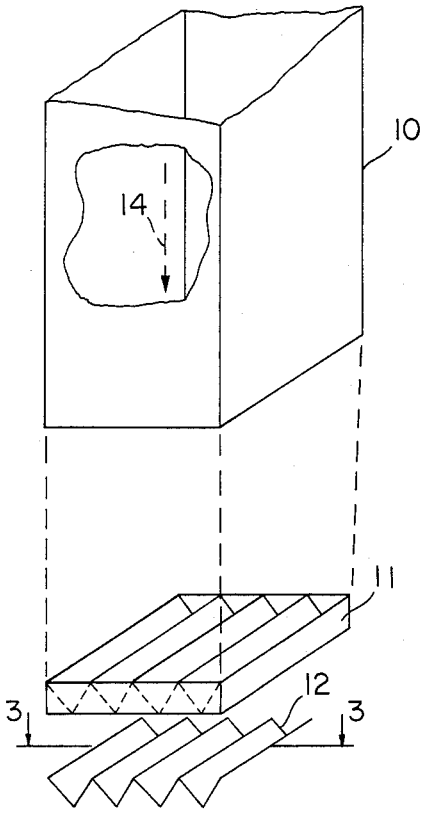
FIG. 1 is an exploded view of an air delivery system partially cut away showing the positions of filters therein.

FIG. 1 shows an air duct 10 for supplying air to a clean room. The duct is adapted by brackets (not shown) to accept a mechanical filter 11 and a filter 12 in accordance with the principles of this invention. The duct is connected to an air supply adapted to direct the air stream downward as viewed in a direction represented by arrow 14. Thus, if a mechanical filter is to be used, it is placed upstream of the electronic filtering unit 12.

A preferred mechanical filter is of the HEPA type. Such filters are commercially available and are corrugated to increase the filter area in the air stream. The construction and physical shape of filter 12 conveniently conforms to the corrugations of the HEPA filter.

Figure 3:
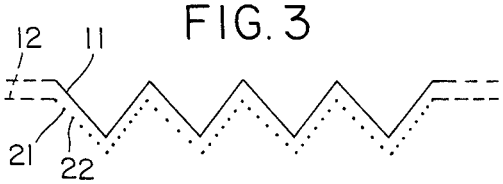
FIG. 3 is a sectional view of a fragment of the filter of FIG. 1 along the line 3—3.
Figure 2:
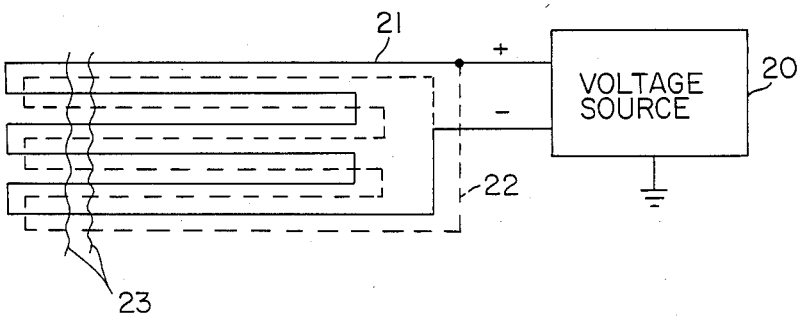
FIG. 2 is a schematic representation of the wires of one of the filters of FIG. 1.

Filter 12 conveniently may be thought of as constructed in a plane with two wire loops 21 and 22 each connected between the positive and negative terminal of a D.C. voltage source 20 electrically in parallel as shown in FIG. 2. The wires of the two loops are interleaved with one another to provide alternate positive and negative polarities on adjacent wires. The wires may serve as a warp into which non conducting fibers may be woven to secure the wires in position. Wire 22 is represented by a broken line solely to indicate that it is different from wire 21. Threads 23 represent the fibers of the woof. Filter 12 preferably is configured such that the plane of FIG. 2, in practice, is constructed to have a corrugated cross section as represented in FIG. 3. It is convenient for the corrugations of filter 12 to be adapted such that filter 11 and 12 mate as shown in FIG. 3. It may even be practical for wires 21 and 22 to be woven into the material of filter 11 in order to achieve a desired close proximity of the two filters. The corrugations of filter 12 are between one half inch to two inches deep, adjacent wires of the filter being spaced apart on two hundred mil centers. Twenty mil insulated wire is used illustratively. Filter 12 is operative to remove particles of from 0.1 micron to 1.0 micron from the air, generating voltage of about 500 to 4000 with leakage currents of 0.1 microamperes/sq ft dissipating about 0.4 milliwatts of power/sq. ft. Ideally there is no power consumption.

Figure 5:
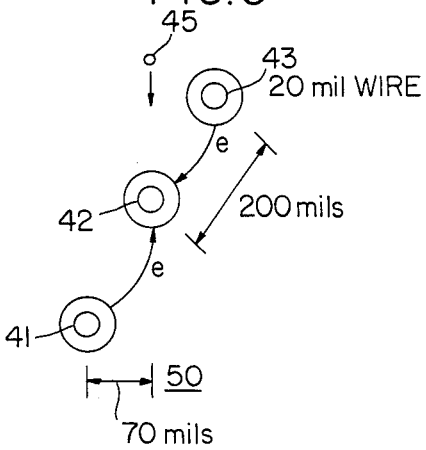
FIG. 5 is an enlarged cross sectional view of adjacent wires of the fragment of FIG. 4.
Figure 4:
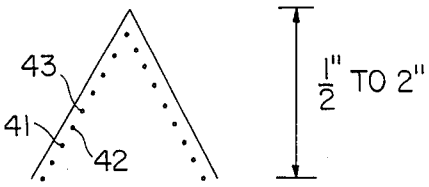
FIG. 4 is an enlarged cross sectional view of a single corrugation shown in FIG. 3.

FIG. 4 shows a cross section of a single corrugation of the filter of FIG. 3. Three adjacent turns or legs of wires 21 and 22 are designated 41, 42 and 43 in FIG. 4 and shown enlarged in FIG. 5. In 45 degree corrugations, a particle 45 in FIG. 5 "sees" a spacing 50 between adjacent wires which is about 70 mils or about one third the actual spacing (200 mils) between adjacent wires. Consequently, the particle not only is subjected to high field gradients due to the alternating polarities but comes relatively close to the wires than would be the case in a planar arrangement of wires. The increased field gradient and close proximity of the particles to the wires results in the removal of particles down to about 0.01 micron size in response to input of ±1000 volts. The system is satisfactory for meeting requirements for better than a class one clean room.

Figure 6:
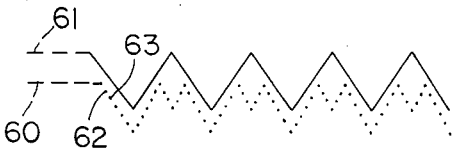
FIG. 6 is a cross sectional view of an alternative filter of the type useful in the air delivery system of FIG. 1.

FIG. 6 shows a cross section of an alternative embodiment where filter 60 in accordance with the principles of this invention is adapted to have corrugations of half the period and half the magnitude of the corrugations of a mating mechanical filter 61. Once again, first and second wires 62 and 63 are connected as shown in FIG. 2 in this embodiment also.

In order to achieve operation of like efficiency employing like polarity wires actually operating in a plane, the wires would have to be placed so close together that they would obstruct air flow significantly and at the expense of significantly higher power dissipation.

Figure 7:
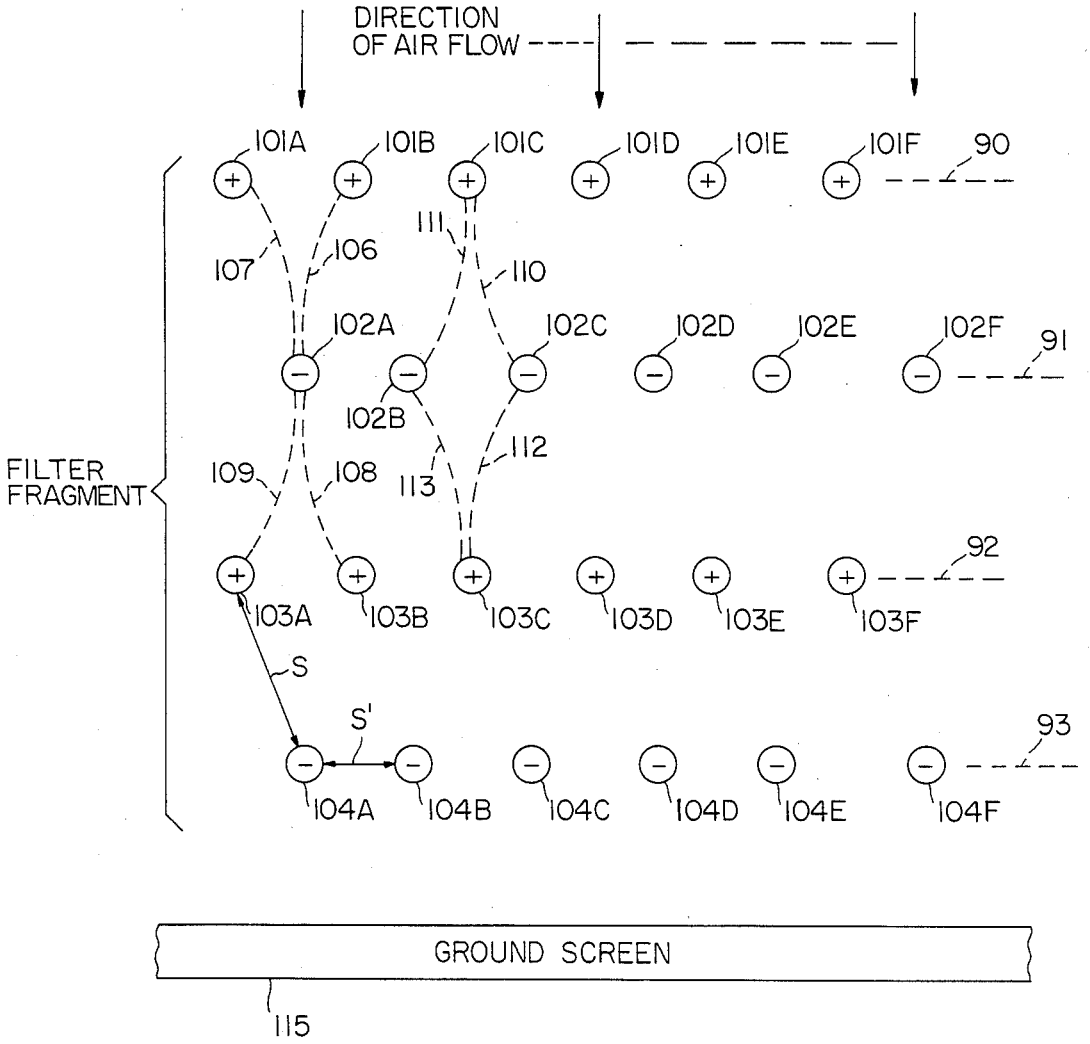
FIG. 7 is a cross section of a fragment of a filter embodiment alternative to that shown in FIGS. 1 through 6.

FIG. 7 shows a cross section of a wire plane like that of FIG. 1 comprising a plurality of wires like 21 and 22 in FIG. 2 in subplanes 90, 91, 92 and 93. The segments of the top one of four representative wires are designated 101A, 101B, 101C, 101D, 101E and 101F in FIG. 7. The plus signs in the circles representing the wire turns or legs indicate that a wire is maintained at a positive potential. The next wire down includes legs 102A, 102B, 102C, 102D, 102E, and 102F (an even number of segments are always used). The next lower wires have their respective legs similarly designated, namely 103A, 103B, 103C, 103D, 103E, and 103F; and 104A, 104B, 104C, 104D, 104E and 104F, respectively. The legs of the planes can be seen to be offset with respect to like-designated legs in the next adjacent plane, adjacent planes being separated a distance about equal to about four times the wire diameter. Multiplane filter configurations of the type shown in FIG. 7 are operative to produce an electrostatic gradient in a volume which is equivalent to a "vacuum" in the field which is cone-shaped as indicated by broken lines 106 and 107 and 108 and 109 and by broken lines 110 and 111 and 112 and 113. Charged particles within the "vacuum" tend to move towards an oppositely charged wire, thereby emptying the "vacuum" of charge particles. Notice that the "vacuum" occurs between positively charge segments in the first instance and between negatively charged segments in the second. These cone shapes are analogous to the corrugations achieved with a single plane filter as shown in FIGS. 1 through 6. Of course, a multiplane filter as shown in FIG. 7 is not corrugated to mate with a corrugated mechanical filter.

The distance between a positively charged leg and a negatively charged leg is large compared to the distance between adjacent like-charged legs in FIG. 7. If, for example, the diameter of a leg including the insulation is D, then the distance S between legs of unlike charge is greater than 4D and the distance S′ between like-charged legs, is approximately 2D. It is clear that negative particles and positive particles are swept out of respective field vacuums to oppositely charged wire segments. Neutral particles will be less affected by the field vacuum, but will still have some attraction due to electrostatic dipole formation in the particle.

It is convenient to include a ground screen astride the air flow path further down stream of the filter as represented in the embodiment of FIG. 7 by broken rectangle 115.

What is claimed is:

1. An electrostatic filter for removing particles from an air stream, said filter comprising a plurality of electrically conducting wires, said conducting wires being electrically insulated, means for maintaining alternate ones of said conducting wires at voltages of opposite polarities, said conducting wires being arranged in a first layer, said layer having a first corrugated cross section along an axis perpendicular to the axes of said conducting wires.

2. An electrostatic filter in accordance with claim 1 in combination with a mechanical filter, said mechanical filter having a second corrugated cross section, said first layer being mated with said mechanical filter so that said first and second corrugated cross sections engage each other.

3. A filter in accordance with claim 2 wherein said first layer has a greater number of corrugations than said mechanical filter.

4. A filter in accordance with claim 1 wherein said plurality of electrically conducting wires comprises first and second wires each having first and second ends, each of said first and second wires being arranged in a serpentine path in said layer including legs, the legs of said first wire being interleaved with the legs of said second wire.

5. A filter in accordance with claim 4 wherein said means for maintaining said wires at voltages of opposite polarities comprises a source of positive and negative potential, said source of positive potential being connected to said first wires, said source of negative potential being connected to said second wires, whereby said first and second wires are maintained at opposite polarities.

6. A filter in accordance with claim 1 wherein said plurality of wires comprises the threads of a warp, said filter also including threads of electrically insulating material interleaved with said wires along axes perpendicular to the axes of said wires to provide a woof for imposing structural stability to said wires.

7. An electrostatic filter for removing particles from an air stream, said filter comprising a plurality of electrically conducting wires, each of said conducting wires including an electrically insulated coating, means for maintaining alternate ones of said conducting wires at voltages of opposite polarities, said wires being arranged to form a pattern of positions of relatively high field intensity gradients in the air stream, said plurality of wires comprising first and second wires, said first wires being arranged in a plane, said second wires being arranged in a plane spaced from and adjacent said plane of said first wires, each of said first and second wires comprising a single wire arranged in a serpentine path so as to define legs, the legs of said first wires being offset to the legs of said second wires so as to achieve said pattern.

* * * * *